US012709311B2

(12) United States Patent
Jones et al.

(10) Patent No.: US 12,709,311 B2
(45) Date of Patent: Aug. 18, 2026

(54) RAILROAD CAR

(71) Applicant: Gunderson LLC, Portland, OR (US)

(72) Inventors: Peter L. Jones, Southlake, TX (US); Caglar Ozerdim, Dallas, TX (US); Xiaoyan Lu, Arlington, TX (US)

(73) Assignee: Gunderson LLC, Lake Oswego, OR (US)

( * ) Notice: Subject to any disclaimer, the term of this patent is extended or adjusted under 35 U.S.C. 154(b) by 700 days.

(21) Appl. No.: 18/310,146

(22) Filed: May 1, 2023

(65) Prior Publication Data

US 2024/0367698 A1 Nov. 7, 2024

(51) Int. Cl.
*B61D 19/00* (2006.01)
*B61D 17/08* (2006.01)

(52) U.S. Cl.
CPC ..... *B61D 19/001* (2013.01); *B61D 17/08* (2013.01)

(58) Field of Classification Search
CPC ..... B61D 17/08; B61D 19/001
See application file for complete search history.

(56) References Cited

U.S. PATENT DOCUMENTS 664,646 A 12/1900 King
1,627,216 A * 5/1927 Wasberg ..... B61D 19/005 52/630
1,885,145 A * 11/1932 Shafer ..... B61D 19/005 49/426
1,914,053 A * 6/1933 Tatum ..... B61D 19/005 49/474
2,344,222 A * 3/1944 Trautvetter ..... B61D 19/02 52/204.593
2,736,270 A * 2/1956 Esher ..... B61F 1/06 105/172
3,039,525 A * 6/1962 Starr ..... B61D 19/002 160/40
3,121,260 A * 2/1964 Decker ..... E05F 9/00 49/460
3,382,909 A * 5/1968 Gardner ..... B61D 19/002 160/209
3,386,600 A * 6/1968 Betjemann ..... B65D 90/0013 414/142.8
4,068,410 A * 1/1978 Marulic ..... E05B 83/02 49/449
5,299,508 A * 4/1994 Connelly ..... B61D 7/30 105/241.2

(Continued)

FOREIGN PATENT DOCUMENTS

CA 2181747 A1 * 1/1997
CA 2366984 C * 7/2006 ..... B61D 19/00

(Continued)

OTHER PUBLICATIONS

"Pictures of Truck Bodies Formed Using High Strength Steel", available prior to the filing date of this application.

(Continued)

*Primary Examiner* — Jason C Smith
(74) *Attorney, Agent, or Firm* — Neal, Gerber & Eisenberg LLP

(57) ABSTRACT

A box railroad car with one or more door assemblies having doors that are more elastic than known boxcar doors, and that after being engaged in a potentially damaging manner, return or substantially return to their natural or original configurations.

14 Claims, 8 Drawing Sheets

(56) References Cited

U.S. PATENT DOCUMENTS

| | | | | |
|---|---|---|---|---|
| 5,386,674 | A * | 2/1995 | Sfirakis | B61D 45/006 49/503 |
| 5,802,984 | A * | 9/1998 | Thoman | B61D 3/04 105/423 |
| 6,601,522 | B2 * | 8/2003 | Roxby | B61D 17/08 105/355 |
| 7,478,599 | B1 * | 1/2009 | Lydic | B61F 1/02 105/416 |
| 7,784,411 | B2 * | 8/2010 | Forbes | B61D 17/08 296/183.1 |
| 8,215,240 | B2 * | 7/2012 | Graaff | B61D 3/184 105/215.1 |
| 8,910,999 | B2 * | 12/2014 | Schurter | B60J 5/0429 296/146.5 |
| 9,156,478 | B2 * | 10/2015 | Forbes | B61D 17/08 |
| 10,737,705 | B2 * | 8/2020 | Kress | B61F 1/14 |
| 12,434,744 | B2 * | 10/2025 | Aberle | B61D 17/18 |
| 2005/0268815 | A1 * | 12/2005 | Creighton | B61D 27/0081 105/404 |
| 2007/0101895 | A1 | 5/2007 | Forbes et al. | |
| 2014/0261071 | A1 * | 9/2014 | Zaerr | B61D 19/004 105/355 |
| 2017/0008539 | A1 * | 1/2017 | Ring | B61H 15/0057 |
| 2020/0217109 | A1 * | 7/2020 | Anderson | E05B 83/10 |
| 2020/0346670 | A1 | 11/2020 | Nelle et al. | |
| 2024/0367698 | A1 * | 11/2024 | Jones | B61D 17/08 |

FOREIGN PATENT DOCUMENTS

| | | | |
|---|---|---|---|
| CA | 2714733 | A1 | 3/2011 |
| CA | 3078020 | A1 | 11/2020 |
| CN | 202243480 | U | 5/2012 |
| CN | 108313084 | B | 7/2019 |
| EP | 3862243 | A1 | 8/2021 |
| GB | 526138 | A | 9/1940 |
| GB | 2092535 | A | 8/1982 |
| RU | 61662 | U1 | 3/2007 |
| WO | 2015097366 | A1 | 7/2015 |

OTHER PUBLICATIONS

Marsh, Joanna, "Greenbrier, U.S. Steel and Norfolk Southern green the gondola", Freightwaves, available at https://www.freightwaves.com/news/greenbrier-us-steel-and-norfolk-southern-green-the-gondola, Dec. 9, 2021.

* cited by examiner

FIG. 8

Door Panel Impact Strength Comparison Tests Results

| Door Type | Door Panel | Most Critical/Frequent Door Panel Impact, at 30,000 lbs Bottom Horizontal Airbag Pressure, AAR Requirement | | | | Maximum Impact at Door Panel Before Door Permanent Deformation | | | Strength Improvement, Force %, Door Panel only * | Strength Improvement, Force %, All Door Components * | Comments |
|---|---|---|---|---|---|---|---|---|---|---|---|
| | | Maximum swing-out Deflection, in | Maximum Von Mises Stress, psi | Location | Allowable Stress at Maximum Stress member, psi | Maximum swing-out Deflection, in | Maximum force on door panel. lbs | Corresponding Airbag Pressure, psi | | | |
| **Example HSS Boxcar Door** | Grade 50, 0.109" Thick | 1.15 | 51,188 | Door Fulcrum | 50,000 | 1.24 | **34,900** | **7.0** | -- | -- | Permanent deformation at fulcrum first |
| **Example AHSS Boxcar Door of Present Disclosure** | Grade 100, 0.109" Thick | 1.15 | 74,528 | Door Vertical Edge | 100,000 | 1.76 | **70,000** | **14.0** | **101%** | **133%** | |
| **Example UHSS Boxcar Door of Present Disclosure** | Grade 175, 0.109" Thick | 1.15 | 74,528 | Door Vertical Edge | 175,000 | 2.33 | **122,000** | **24.4** | **250%** | **307%** | |

RAILROAD CAR

BACKGROUND

The railroad industry employs a variety of different railroad cars for transporting different materials. For example, various known railroad cars that are configured to carry packaged materials are often called "box railroad cars" or simply "boxcars." Various known boxcars are subject to various different types of damage that can require extra maintenance resources, limit the service time, and limit the lifespans of such boxcars.

One such type of damage is damage to the doors of such boxcars. Boxcars typically have one or two sets of doors with each set on one of the sides of the boxcar. Each set of doors typically includes two doors both mounted on upper and lower tracks and separately openable and closeable. Each door includes: (1) a door frame, (2) top, center, and bottom panels connected to and supported by the door frame, and (3) a locking assembly connected to and supported by the door frame. The locking assembly is operable (by an operator) to lock that door in the closed position, to unlock the door, to move the door to the open position, and to move the door to the closed position. The top, center, and bottom panels are on the interior side of the door and the locking assembly is on the exterior side of the door. When one or more of these components of a door are damaged, the door can be difficult or impossible to open, close, lock, and unlock.

Accordingly, there is a continuing need to provide boxcars that are less prone to damage, require less maintenance, are out of service for shorter periods of time, and have longer expected lifespans.

SUMMARY

Various embodiments of the present disclosure provide a railroad car such as a that is less prone to damage than conventional boxcars, which requires less maintenance than conventional boxcars, which is out of service for shorter periods of time than conventional boxcars, and that has a longer expected lifespan than conventional boxcars. Various embodiments of the present disclosure provide doors for a boxcar that are more elastic and less susceptible to yielding than known boxcar doors, and that after being engaged in a potentially damaging manner, return or substantially return to their original shape or "as built" configuration. In various embodiments, certain components of the doors of the boxcar of the present disclosure are made from advanced high strength steel and/or certain ultra-high strength steel, such that the doors are more elastic than conventional boxcar doors.

Other objects, features, and advantages of the present disclosure will be apparent from the following detailed disclosure, taken in conjunction with the accompanying sheets of drawings, wherein like reference numerals refer to like parts.

BRIEF DESCRIPTION OF THE FIGURES

FIG. 8 is a table showing the results of test conducted on two example doors constructed in accordance with various example embodiments of the present disclosure in comparison to a known boxcar door.

DETAILED DESCRIPTION

Figure 1:
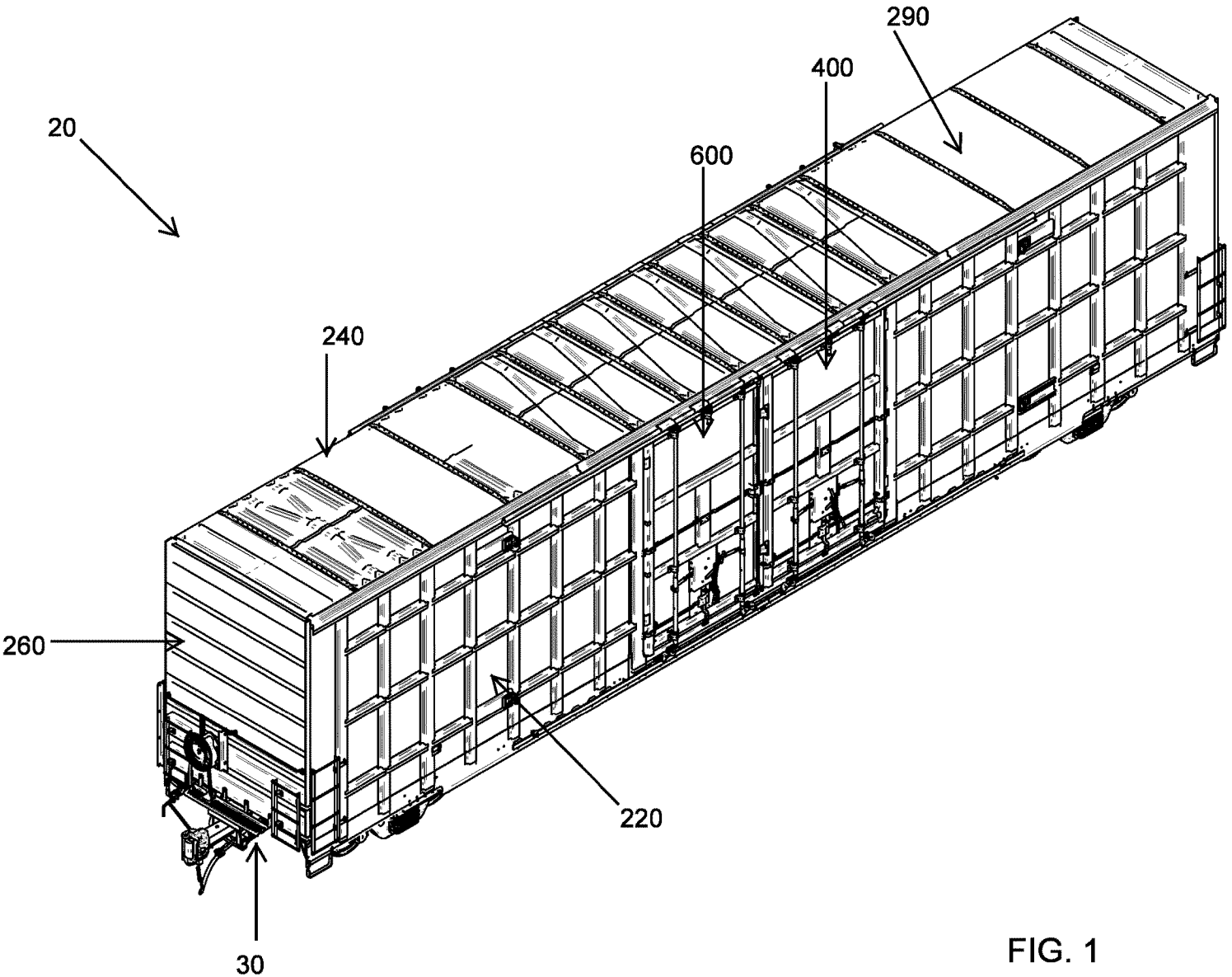
FIG. 1 is a top side exterior perspective view of a boxcar of one example embodiment of the present disclosure, shown without the trucks and wheels of the boxcar, and shown with the doors on one side of the boxcar in the respective closed positions.

While the features, devices, and apparatus described herein may be embodied in various forms, the drawings show, and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Various embodiments of the present disclosure provide a boxcar with one or more door assemblies having doors that are more elastic than known boxcar doors, and that after being engaged in a potentially damaging manner, return or substantially return to their original shape or "as built" configuration. In various such embodiments, such doors are less prone to damage than doors of conventional boxcars, require less maintenance than doors of conventional boxcars, cause the boxcar to be out of service for shorter periods of time that boxcars with conventional doors, and have longer expected lifespans than doors of conventional boxcars. In various embodiments, as further described below, certain components of the doors of the boxcar of the present disclosure are made from advanced high strength steel and/or certain ultra-high strength steel, such that the doors are more elastic than conventional boxcar doors.

The present disclosure provides boxcar door configurations that also take into account certain of the primary causes of damage to boxcar doors to address, prevent, and/or minimize the damage to the boxcar doors of the present disclosure due to such causes. More specifically, damage to boxcar doors has previously been thought to be primarily due to undesired contacts with the exterior components of the doors or on the exterior side of the doors by vehicles and equipment used to load and unload products in the boxcars. The present disclosure recognizes that damage to boxcar doors is actually often primarily due to undesired contacts with the interior components of or from the interior side of the boxcar doors by vehicles and equipment inside the boxcars that are used to load and unload products in the boxcars. For example, when a boxcar is being loaded, often only one door on one side of the boxcar is opened and the other door on that side of the boxcar is left closed. When a forklift driver loads pallets (with products thereon) in the boxcar, the forklift driver will often intentionally or unintentionally back the forklift into and thus engage the interior side of the closed door and use that closed door as somewhat of a pivot point in the loading process. Likewise, when a boxcar is being unloaded, often only one door on a side of the boxcar is opened and the other door on that side is left closed. When a forklift driver unloads pallets (with products thereon) from the boxcar, the forklift driver will often also back the forklift into and thus engage the interior side of the closed door and again use that closed door as somewhat of a pivot point in the unloading process. Thus, the present disclosure better recognizes and structures the boxcar doors to more specifically account for the fact that the damage to the boxcar doors is more likely to occur from the interior of the boxcars rather than from the exterior of the boxcars. As indicated above, the interior sides of the doors have the top, center, and bottom panels that are attached to the door frame that faces the exterior of the boxcar. The present disclosure contemplates configuring the doors to thus be more elastic when these panels are contacted in an undesired manner (such as described above) and to minimize damage to such boxcar doors in such instances.

For purposes of description of the components of the illustrated example boxcar described herein, the longitudinal direction is generally used to describe a direction of travel of or the length of the boxcar, and the transverse direction is generally used to describe a direction lateral or perpendicular to the direction of travel of the boxcar.

Referring now to the drawings, FIGS. 1, 2, 3, 4, 5, 6, and 7 illustrate certain components of a boxcar 20 of an example embodiment of the present disclosure. This boxcar 20 generally includes: (1) a frame 30; (2) spaced apart trucks (not shown) configured to support the frame 30; (3) a plurality of sets of wheel assemblies (not shown) that respectively support the trucks; (4) a floor 200 connected to and supported by the frame 30; (5) a first side wall 220 connected to and extending upwardly from the floor 200 and/or the frame 30; (6) a spaced-apart second side wall 240 connected to and extending upwardly from the floor 200 and/or the frame 30; (7) a first end wall 260 connected to and extending upwardly from the floor 200 and/or the frame 30; (8) a spaced-apart second end wall 280 connected to and extending upwardly from the floor 200 and/or the frame 30 connected to the floor 200; and (9) a roof 290 connected to the first side wall 220, the second side wall 240, the first end wall 260, and the second end wall 280. The first side wall 220 includes a first door assembly 300. The second sidewall 240 of the boxcar 20 can additionally include a second door assembly (not shown) on the opposite second side wall 280 of the boxcar 20. Such a second door assembly can be identical to the first door assembly and as such is thus not described in detail herein for brevity. Additionally, except for the door assembly 300, these components of the boxcar can be any known boxcar components or any future developed boxcar components and are thus not described herein for brevity. Additionally, the components, size, and configuration of the boxcar can also vary in accordance with the present disclosure.

Figure 2:
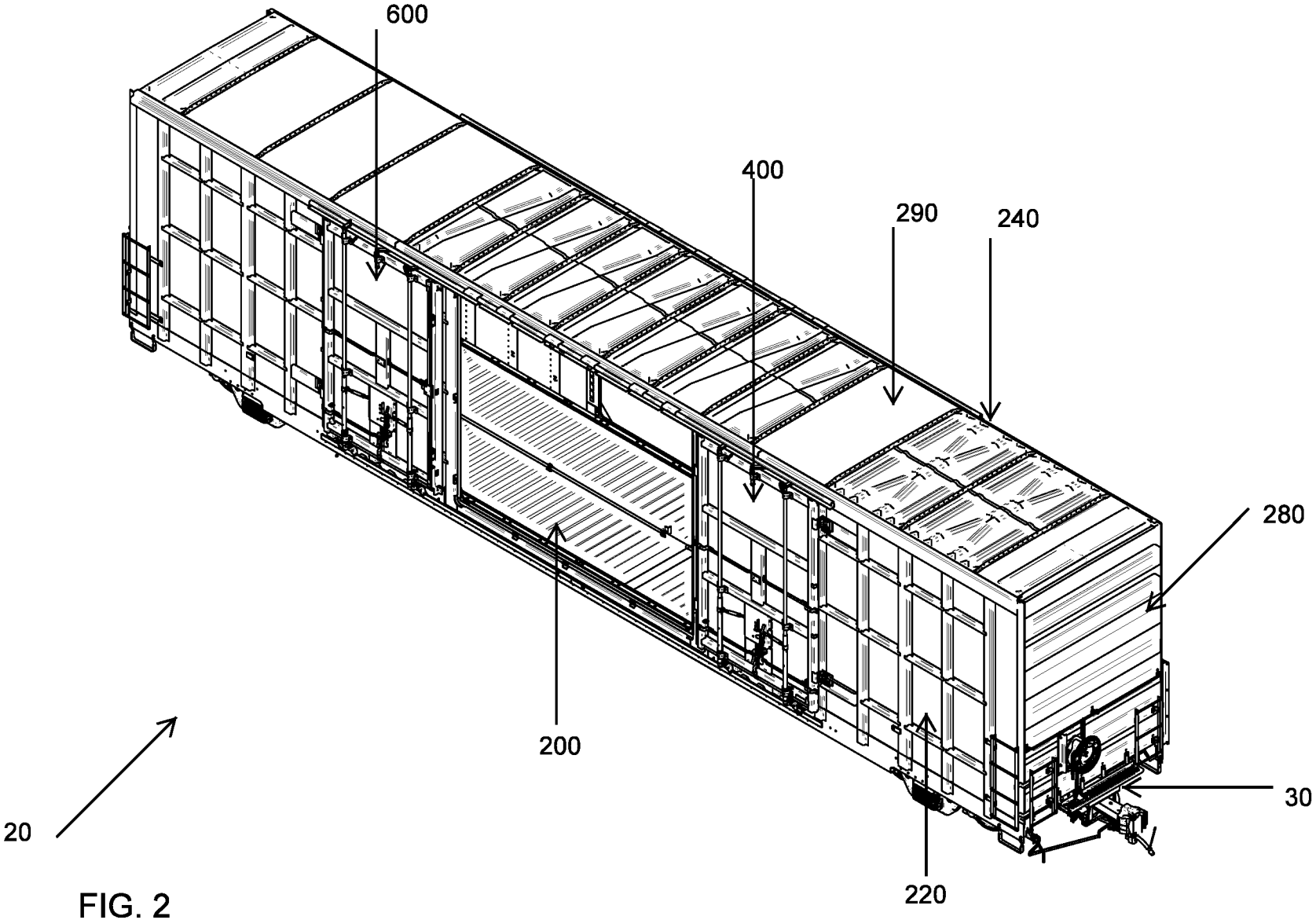
FIG. 2 is a top side exterior perspective view of the boxcar of FIG. 1, shown without the trucks and wheels of the boxcar, and shown with the doors on one side of the boxcar in the respective open positions.
Figure 3:
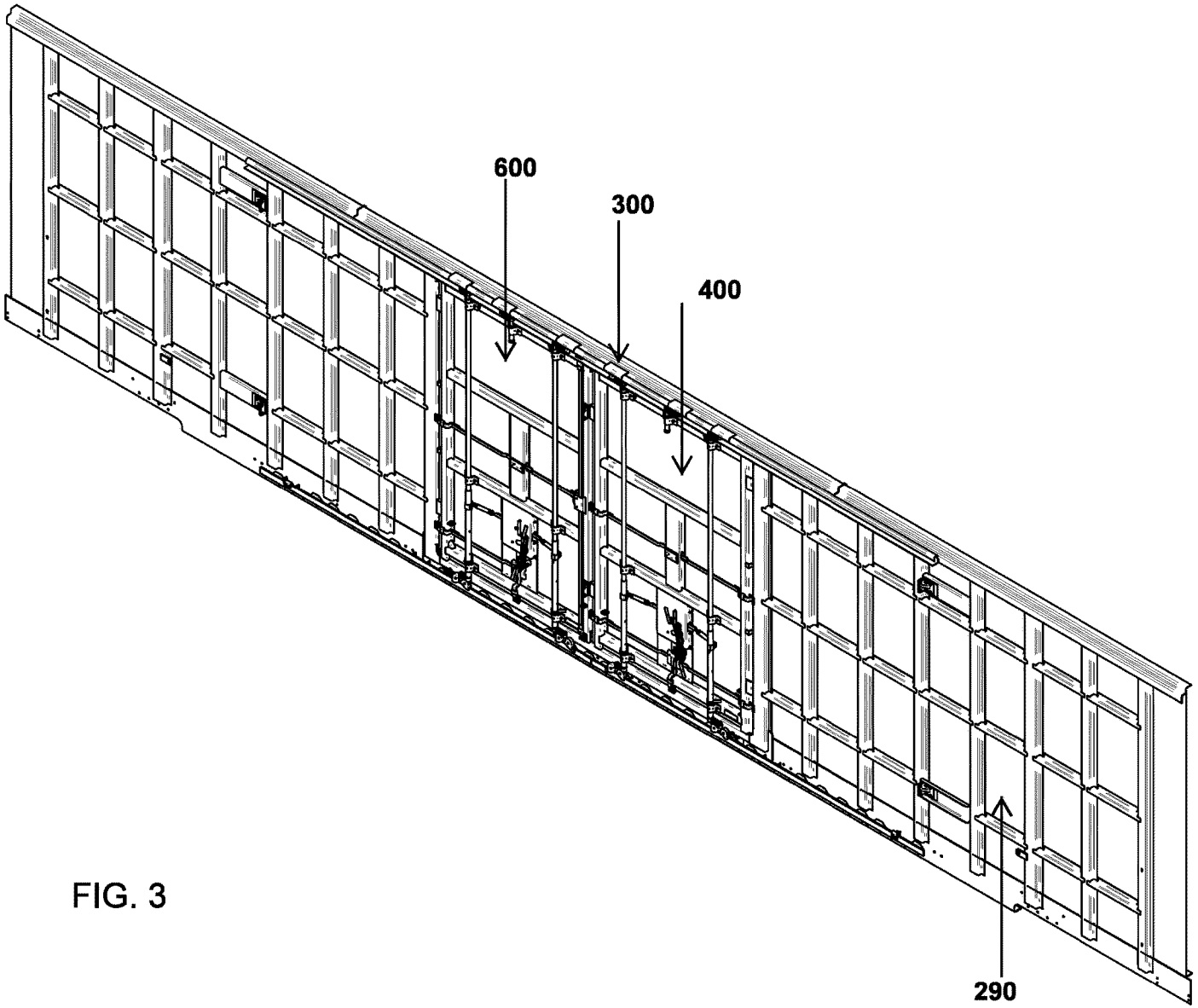
FIG. 3 is a top side exterior perspective view of one side of the boxcar of FIG. 1, shown with the doors of that side of the boxcar in the respective closed positions.
Figure 4:
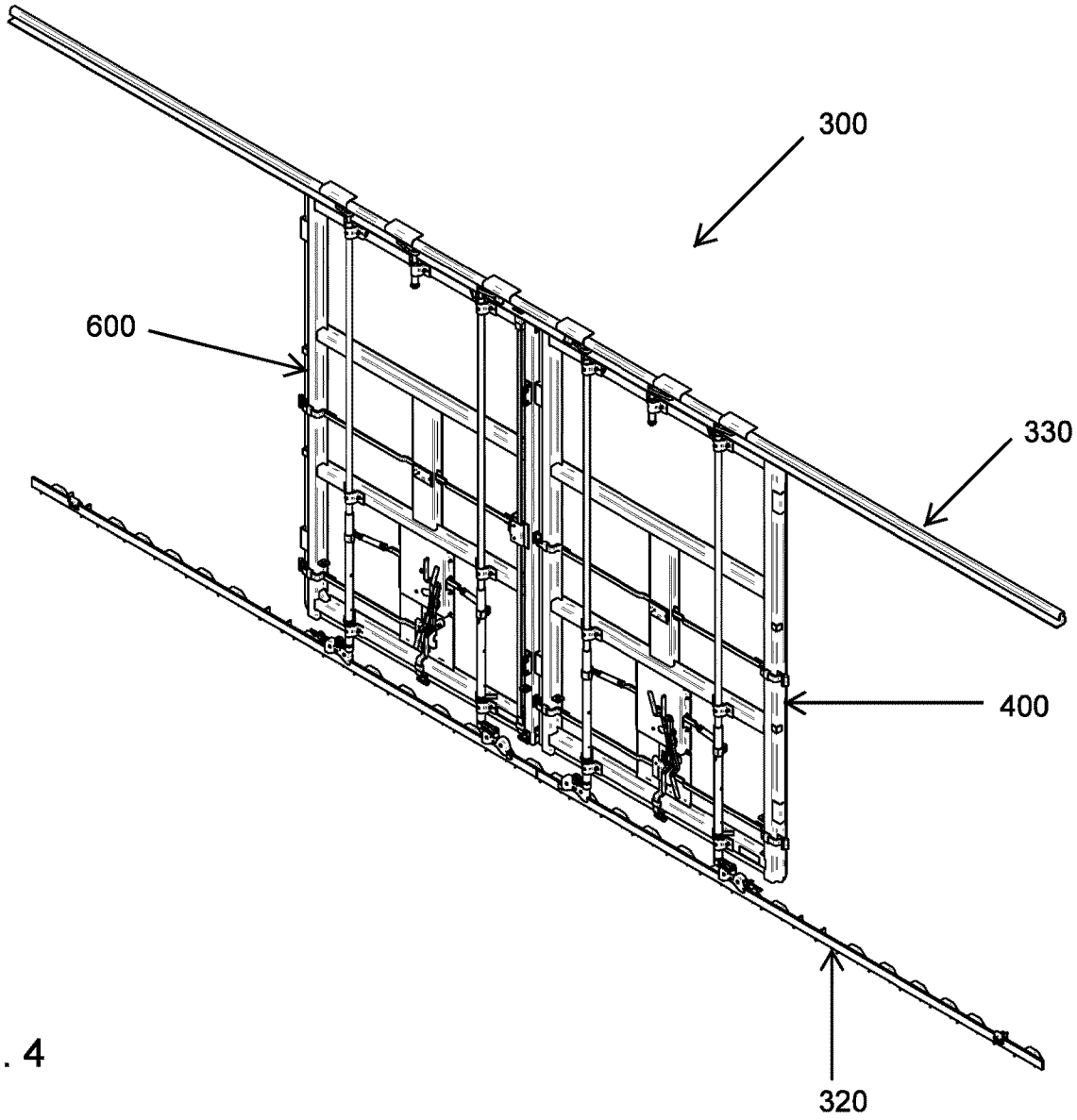
FIG. 4 is an enlarged top side exterior perspective view of the doors and tracks of one side of the boxcar of FIG. 1, shown with the doors in the respective closed positions.
Figure 5:
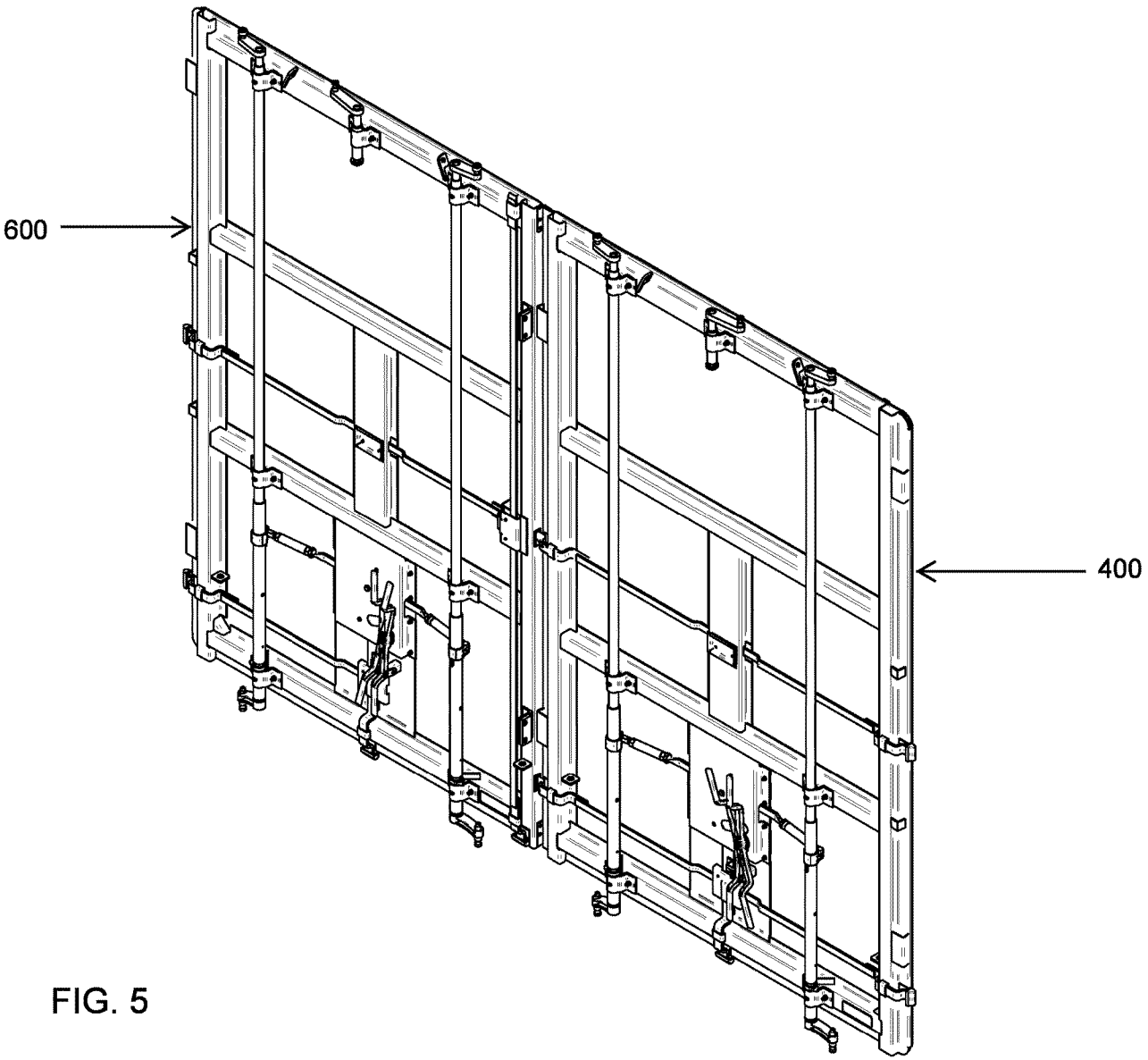
FIG. 5 is a further enlarged top side exterior perspective view of the doors of one side of the boxcar of FIG. 1, shown with the doors in the respective closed positions.

This illustrated example door assembly 300 generally includes: (1) a bottom door track 320; (2) a top retainer 330; (3) a first (or main) door 400 movable on the bottom door track 320; and (4) a second (or auxiliary) door 600 movable on the bottom door track 320. Each of the doors 400 and 600 are separately moveable from a respective closed and locked position to a respective open position. FIGS. 1, 3, 4 and 5 show the doors 400 and 600 in the respective closed positions. FIG. 2 shows the doors 400 and 600 in the respective open positions. In this example embodiment, the doors 400 and 600 are known as the auxiliary and main doors. In this example embodiment, the door 400 is closed first and door 600 closes over the door 400 to create an overlapping seal between the two doors. For brevity, only door 400 is described in detail.

Figure 6:
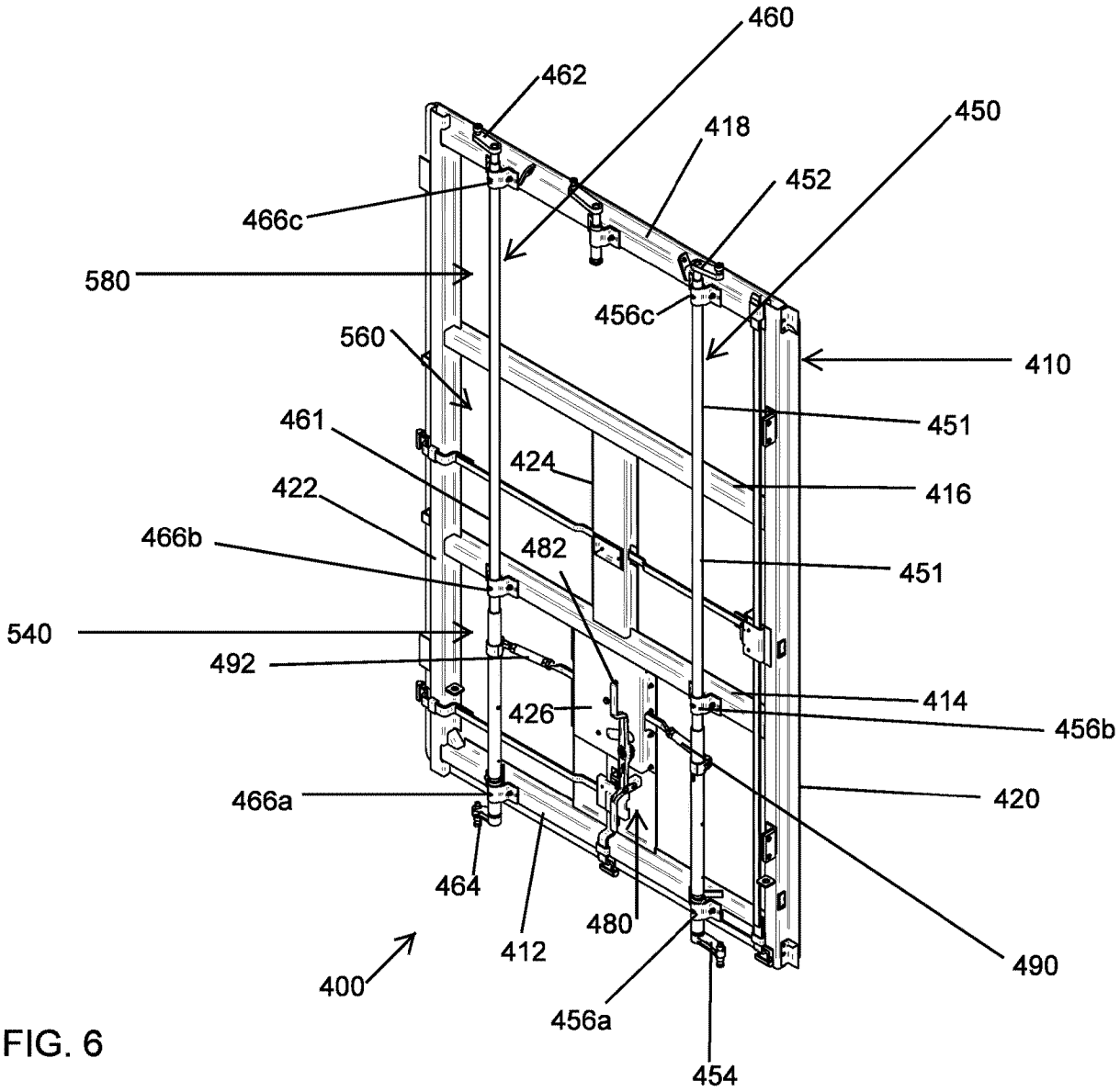
FIG. 6 is a further enlarged top side exterior perspective view one of the doors of one side of the boxcar of FIG. 1.
Figure 7:
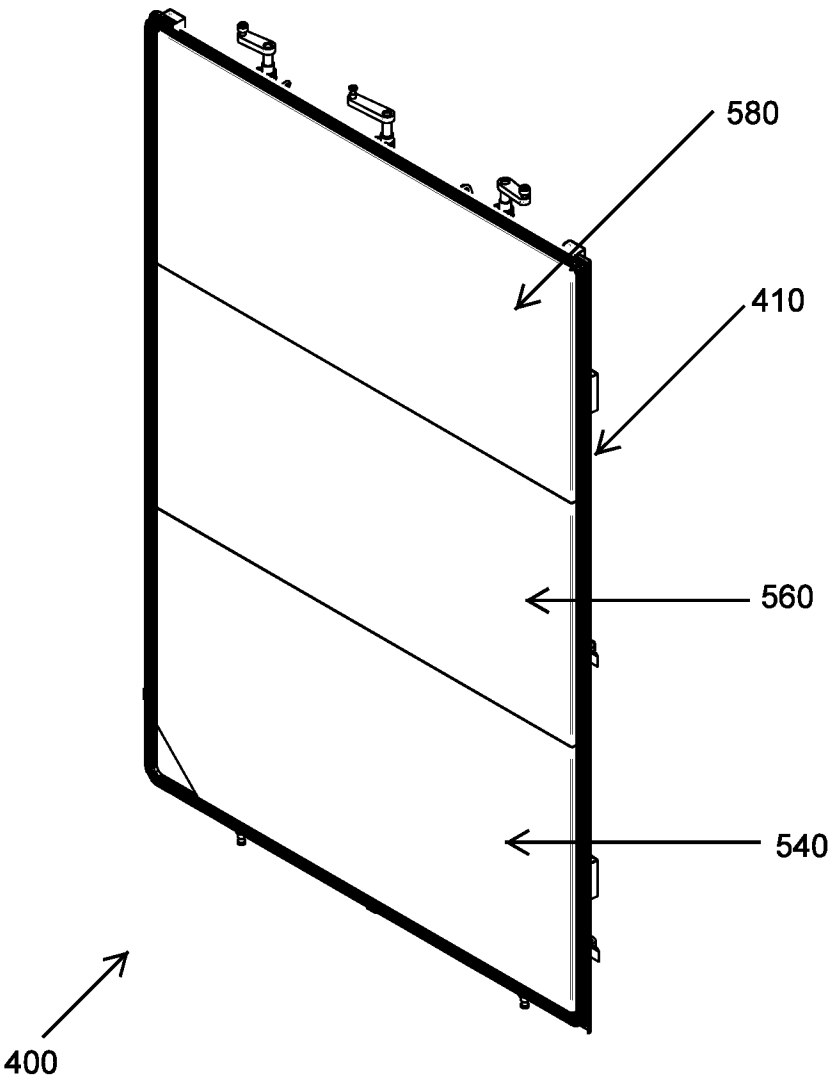
FIG. 7 is a further enlarged top side interior perspective view one of the doors of one side of the boxcar of FIG. 1.

As best shown in FIGS. 6 and 7, this illustrated example door 400 includes: (1) a door frame assembly 410; (2) first and second connection pipe assemblies 450 and 460 connected to the door frame assembly 410; (3) a locking assembly 480; and (4) first (bottom), second (center), and third (top) interior panels 540, 560, and 580 connected to the door frame assembly 410.

More specifically, the door frame assembly 410 includes: (1) a first (lower) longitudinally and horizontally extending member 412; (2) a second (central) longitudinally and horizontally extending member 414; (3) a third (central) longitudinally and horizontally extending member 416; (4) a fourth (upper) longitudinally and horizontally extending member 418; (5) a first (side) vertically extending member 420; (5) a second (side) vertically extending member 422; (6) a third (central) vertically extending member 424; and (7) a fourth (central) vertically extending member 426.

The first connection pipe assembly 450 includes: (1) a vertically extending lock rod 451; (2) an upper cam 452 attached to the top of the lock rod 451 and including an upper locking finger (not labeled) that extends from the lock rod 451; (3) a lower cam 454 attached to the bottom of the lock rod 451, and that includes an lower locking finger (not labeled) that extends from the lock rod 451; and (4) brackets 456*a*, 456*b*, and 456*c* that respectively rotatably secure the lock rod 451 to the first (lower) member 412, the second (central) member 414, and the fourth (upper) member 418.

Likewise, the second connection pipe assembly 460 includes: (1) a vertically extending lock rod 461; (2) an upper cam 462 attached to the top of the lock rod 461 and including an upper locking finger (not labeled) that extends from the lock rod 461; (3) a lower cam 464 attached to the bottom of the lock rod 461, and that includes an lower locking finger (not labeled) that extends from the lock rod 461; and (4) brackets 466*a*, 466*b*, and 466*c* that respectively rotatably secure the lock rod 461 to the first (lower) member 412, the second (central) member 414, and the fourth (upper) member 418.

The locking assembly 480 includes: (1) a handle assembly 482 including a handle 484; (2) a gear assembly (not shown); (3) a first linkage 490 connecting the gear assembly to the lock rod 451; and (4) a second linkage 492 connecting the gear assembly to the lock rod 461. The locking assembly 480 is configured such that actuation of the handle 484 causes rotation of the actuation of the lock rods 451 and 461. The rotation of the lock rods 451 and 461 cause the door to move into and plug the opening in the side of the box car.

The first (bottom) interior panel 540 includes a generally rectangular first member that is fixedly attached to the first (lower) member 412, the second (central) member 414, the first (side) member 420, and the second (side) member 422.

The second (center) interior panel 560 includes a generally rectangular second member that is fixedly attached to the second (central) member 414, the third (central) extending member 416, the first (side) member 420, and the second (side) member 422.

The third (top) interior panel 580 includes a generally rectangular third member that is fixedly attached to the third (central) member 416, the fourth (upper) member 418, the first (side) member 420 and the second (side) member 422.

To better understand the present disclosure, it should be appreciated that the ability of a steel to resist permanent deformation is often expressed in units of "ksi" (or kilopounds per square inch) with 1 ksi being equal to 1,000 pounds per square inch. The unit "ksi" can be considered as a measure of the tensile strength of steel. Pascals ("Pa") or megapascals ("MPa") are also often used for providing the measurement of tensile strength measured as a force per unit area—the unit being a pascal or megapascal. Tensile strength measures the level of stress a material can take before failing. This often refers to the stress created by stretching or pulling the material apart. It should further be appreciated that the higher the ksi or MPa is for a steel member, the more resistant the steel member is to permanent deformation. In other words, the higher the ksi or MPa of a steel member, the more elastic that steel member is, and the more likely that steel member is to return to its original configuration after being engaged by a force that is less a threshold level of force that causes a permanent deformation and thus reconfiguration of the steel member (which is referred to herein as "yield stress").

To also better understand the present disclosure, it should further be appreciated that:

(1) what is often referred to as High Strength Steel ("HSS") has a yield strength between 30-80 ksi (210-550 MPa) and a tensile strength between 40-100 ksi (270 to 700 MPa);

(2) what is often referred to as Advanced High Strength Steel ("AHSS") has a yield strength of 80 ksi (550 MPa) or higher and a tensile strength of 90 ksi (620 MPa) or higher; and (3) what is sometimes referred to as Ultra High Strength Steel ("UHSS") has a yield strength of 140 ksi (965 MPa) or higher and a tensile strength of 170 ksi (1170 MPa) or higher.

To further understand the present disclosure, it should further be appreciated that steel is available in numerous different grades (i.e., at least 3,500 different commercial grades). The grades of steel are determined based on the relative amounts of carbon and additional alloys that compose the steel, and how the manufacturer processes them. For example, carbon steels only contain trace amounts of elements besides carbon and iron. Carbon steels generally have three main subgroups (that depend on how much carbon is in the metal) including: (1) Low Carbon Steels/Mild Steels (up to 0.3% carbon), (2) Medium Carbon Steels (0.3-0.6% carbon), and (3) High Carbon Steels (more than 0.6% carbon). Alloy steels are created by adding additional alloying elements like nickel, copper, chromium, and/or aluminum. Incorporating these elements enhances the steel's strength, ductility, corrosion resistance, and machinability.

Various embodiments of the present disclosure employ a Grade 100 steel that is an Advanced High Strength Steel ("AHSS") containing relatively low amounts of carbon (0.15% max), manganese (2% max), phosphorous (0.02% max), copper (0.2-0.3% max), and sulfur (0.025% max) resulting in a cleaner, more homogeneous material.

In a first example embodiment of the present disclosure, to provide the appropriate elastic configuration of the door 400, the door frame assembly 410, the first and second connection pipe assemblies 450 and 460, and the first, second, and third interior panels 540, 560, and 580 are each made from a Grade 100 AHSS member (having a yield strength of 100 ksi (690 MPa) or higher and a tensile strength of 110 ksi (760 MPa)). In this example embodiment, the locking assembly 480 is made from HSS members (each having a yield strength between 30-80 ksi (210-550 MPa) and a tensile strength between 40-100 ksi (270 to 700 MPa)). In this example embodiment, the door frame assembly 410, the first and second connection pipe assemblies 450 and 460, and the first, second, and third interior panels 540, 560, and 580 all function together to provide the door 400 with a desired amount of elasticity from the interior to the exterior such that when the door 400 in engaged from the interior side (i.e., against one or more of the panels 540, 560, and 580) by an object and with a force less than the force required to reach yield stress, these components return to their original shapes. Specifically, the forces incurred by one or more of the interior panels 540, 560, and 580 are transferred to the door frame assembly 410 and the pipe assemblies 450 and 460, and those components function to absorb such forces and also the interior panels 540, 560, and 580 to return to their original configurations.

In a second example embodiment of the present disclosure, to provide the appropriate elastic configuration of the door 400, the door frame assembly 410, the first and second connection pipe assemblies 450 and 460, and the first, second, and third interior panels 540, 560, and 580 are each made from a Grade 140 UHSS members (having a yield strength of 140 ksi (965 MPa) or higher and a tensile strength of 170 ksi (1170 MPa) or higher. In this example embodiment, the locking assembly 480 is made from HSS members (each having a yield strength between 30-80 ksi (210-550 MPa) and a tensile strength between 40-100 ksi (270 to 700 MPa)). In this example embodiment, the door frame assembly 410, the first and second connection pipe assemblies 450 and 460, and the first, second, and third interior panels 540, 560, and 580 all function together to provide the door 400 with a desired amount of elasticity from the interior to the exterior such that when the door 400 in engaged from the interior side (i.e., against one or more of the panels 540, 560, and 580) by an object and with a force less than a threshold reconfiguring force, these components return to their original shapes. Specifically, the forces incurred by one or more of the interior panels 540, 560, and 580 are transferred to the door frame assembly 410 and the pipe assemblies 450 and 460, and those components function to absorb such forces and also the interior panels 540, 560, and 580 to return to their original configurations.

In third example embodiment of the present disclosure, to provide the appropriate elastic configuration of the door 400, the door frame assembly 410, the first and second connection pipe assemblies 450 and 460, and the first, second, and third interior panels 540, 560, and 580 are each made from a Grade 175 UHSS member (having a yield strength of 140 ksi (965 MPa) or higher and a tensile strength of 170 ksi (1170 MPa) or higher). In this example embodiment, the locking assembly 480 is made from HSS members (each having a yield strength between 30-80 ksi (210-550 MPa) and a tensile strength between 40-100 ksi (270 to 700 MPa)). In this example embodiment, the door frame assembly 410, the first and second connection pipe assemblies 450 and 460, and the first, second, and third interior panels 540, 560, and 580 all function together to provide the door 400 with a desired amount of elasticity from the interior to the exterior such that when the door 400 in engaged from the interior side (i.e., against one or more of the panels 540, 560, and 580) by an object and with a force less than a threshold reconfiguring force, these components return to their original shapes. Specifically, the forces incurred by one or more of the interior panels 540, 560, and 580 are transferred to the door frame assembly 410 and the pipe assemblies 450 and 460, and those components function to absorb such forces and also the interior panels 540, 560, and 580 to return to their original configurations.

In alternative embodiments of the present disclosure, two or all of the first, second, and third interior panels 540, 560, and 580 are made from a single steel member.

The table in FIG. 8 shows the results of test conducted on two example doors constructed in accordance with various example embodiments of the present disclosure in comparison to two known boxcar doors. These tests show the substantial improvements to the elasticity of these example doors and their increased resistance to deformation.

It should be appreciated from the above that various embodiments of the present disclosure provide a railroad car including a frame and a first side wall supported by the frame, the first side wall including a door assembly including first and second doors, wherein at least one of the first and second doors includes: a door frame assembly formed from advanced high strength steel, a plurality of panels connected to the door frame assembly and formed from advanced high strength steel, and a locking assembly connected to the door frame assembly, the locking assembly formed from a high strength steel.

In various such embodiments, the advanced high strength steel has a yield strength of 80 ksi (550 MPa) or higher and a tensile strength of 90 ksi (620 MPa) or higher. In various such embodiments, the high strength steel has a yield strength between 30-80 ksi (210-550 MPa) and a tensile strength between 40-100 ksi (270 to 700 MPa).

In various such embodiments, the railroad car includes first and second connection pipe assemblies connected to the door frame assembly, wherein the first and second connection pipe assemblies include first and second pipes formed from advanced high strength steel. In various such embodiments, the advanced high strength steel has a yield strength of 80 ksi (550 MPa) or higher and a tensile strength of 90 ksi (620 MPa) or higher. In various such embodiments, the high strength steel has a yield strength between 30-80 ksi (210-550 MPa) and a tensile strength between 40-100 ksi (270 to 700 MPa).

It should further be appreciated from the above that various embodiments of the present disclosure provide a railroad car including a frame and a first side wall supported by the frame, the first side wall including a door assembly including first and second doors, wherein at least one of the first and second doors includes: a door frame assembly formed from advanced high strength steel, a plurality of panels connected to the door frame assembly and formed from advanced high strength steel, first and second connection pipe assemblies including first and second pipes formed from advanced high strength steel, and a locking assembly connected to the door frame assembly, wherein the advanced high strength steel has a yield strength of 80 ksi (550 MPa) or higher and a tensile strength of 90 ksi (620 MPa) or higher.

It should further be appreciated from the above that various embodiments of the present disclosure provide a railroad car including a frame and a first side wall supported by the frame, the first side wall including a door assembly including first and second doors, wherein at least one of the first and second doors includes: a door frame assembly formed from ultra high strength steel, a plurality of panels connected to the door frame assembly and formed from ultra high strength steel, and a locking assembly connected to the door frame assembly, the locking assembly formed from a high strength steel.

In various such embodiments, the ultra high strength steel has a yield strength of 140 ksi (965 MPa) or higher and a tensile strength of 170 ksi (1170 MPa) or higher. In various such embodiments, the high strength steel has a yield strength between 30-80 ksi (210-550 MPa) and a tensile strength between 40-100 ksi (270 to 700 MPa).

In various such embodiments, the railroad car includes first and second connection pipe assemblies connected to the door frame assembly, wherein the first and second connection pipe assemblies include first and second pipes formed from ultra high strength steel. In various such embodiments, the ultra high strength steel has a yield strength of 140 ksi (965 MPa) or higher and a tensile strength of 170 ksi (1170 MPa) or higher. In various such embodiments, the high strength steel has a yield strength between 30-80 ksi (210-550 MPa) and a tensile strength between 40-100 ksi (270 to 700 MPa).

It should further be appreciated from the above that various embodiments of the present disclosure provide a railroad car including a frame and a first side wall supported by the frame, the first side wall including a door assembly including first and second doors, wherein at least one of the first and second doors includes: a door frame assembly formed from ultra high strength steel, a plurality of panels connected to the door frame assembly and formed from ultra high strength steel, first and second connection pipe assemblies including first and second pipes formed from ultra high strength steel, and a locking assembly connected to the door frame assembly, wherein the ultra high strength steel has a yield strength of 140 ksi (965 MPa) or higher and a tensile strength of 170 ksi (1170 MPa) or higher.

It will be understood that modifications and variations may be affected without departing from the scope of the novel concepts of the present invention, and it is understood that this application is to be limited only by the scope of the claims.

The invention claimed is:

1. A railroad car comprising:

a frame; and a first side wall supported by the frame, the first side wall including a door assembly including first and second doors, at least one of the first and second doors including:

a door frame assembly formed from advanced high strength steel, a plurality of panels connected to the door frame assembly and formed from advanced high strength steel, each of the plurality of panels having a first shape configuration, and a locking assembly connected to the door frame assembly, the locking assembly formed from a high strength steel, wherein a force incurred by an interior of one or more of the plurality of panels causes the one or more of the plurality of panels to be changed to a second shape configuration different from the first shape configuration, and wherein the force is transferred to and absorbed by the door frame assembly such that the one or more of the plurality of panels is returned from the second shape configuration to the first shape configuration.

2. The railroad car of claim 1, wherein the advanced high strength steel has a yield strength of 80 ksi (550 MPa) or higher and a tensile strength of 90 ksi (620 MPa) or higher.

3. The railroad car of claim 2, wherein the high strength steel has a yield strength between 30-80 ksi (210-550 MPa) and a tensile strength between 40-100 ksi (270 to 700 MPa).

4. The railroad car of claim 1, which includes first and second connection pipe assemblies connected to the door frame assembly, wherein the first and second connection pipe assemblies include first and second lock rods formed from advanced high strength steel.

5. The railroad car of claim 4, wherein the advanced high strength steel has a yield strength of 80 ksi (550 MPa) or higher and a tensile strength of 90 ksi (620 MPa) or higher.

6. The railroad car of claim 5, wherein the high strength steel has a yield strength between 30-80 ksi (210-550 MPa) and a tensile strength between 40-100 ksi (270 to 700 MPa).

7. A railroad car comprising:

a frame; and a first side wall supported by the frame, the first side wall including a door assembly including first and second doors, at least one of the first and second doors including:

a door frame assembly formed from advanced high strength steel, a plurality of panels connected to the door frame assembly and formed from advanced high strength steel, each of the plurality of panels having a first shape configuration, first and second connection pipe assemblies including first and second lock rods formed from advanced high strength steel, and a locking assembly connected to the door frame assembly and formed from a high strength steel, wherein a force incurred by an interior of one or more of the plurality of panels causes the one or more of the plurality of panels to be changed to a second shape configuration different from the first shape configuration, and wherein the force is transferred to and absorbed by one or more of the door frame assembly and the first and second connection pipe assemblies such that the one or more of the plurality of panels is returned from the second shape configuration to the first shape configuration, wherein the advanced high strength steel has a yield strength of 80 ksi (550 MPa) or higher and a tensile strength of 90 ksi (620 MPa) or higher.

8. A railroad car comprising:

a frame; and a first side wall supported by the frame, the first side wall including a door assembly including first and second doors, at least one of the first and second doors including:

a door frame assembly formed from ultra high strength steel, a plurality of panels connected to the door frame assembly and formed from ultra high strength steel, each of the plurality of panels having a first shape configuration, and a locking assembly connected to the door frame assembly, the locking assembly formed from a high strength steel, wherein a force incurred by an interior of one or more of the plurality of panels causes the one or more of the plurality of panels to be changed to a second shape configuration different from the first shape configuration, and wherein the force is transferred to and absorbed by the door frame assembly such that the one or more of the plurality of panels is returned from the second shape configuration to the first shape configuration.

9. The railroad car of claim 8, wherein the ultra high strength steel has a yield strength of 140 ksi (965 MPa) or higher and a tensile strength of 170 ksi (1170 MPa) or higher.

10. The railroad car of claim 9, wherein the high strength steel has a yield strength between 30-80 ksi (210-550 MPa) and a tensile strength between 40-100 ksi (270 to 700 MPa).

11. The railroad car of claim 8, which includes first and second connection pipe assemblies connected to the door frame assembly, wherein the first and second connection pipe assemblies include first and second lock rods formed from ultra high strength steel.

12. The railroad car of claim 11, wherein the ultra high strength steel has a yield strength of 140 ksi (965 MPa) or higher and a tensile strength of 170 ksi (1170 MPa) or higher.

13. The railroad car of claim 12, wherein the high strength steel has a yield strength between 30-80 ksi (210-550 MPa) and a tensile strength between 40-100 ksi (270 to 700 MPa).

14. A railroad car comprising:

a frame; and a first side wall supported by the frame, the first side wall including a door assembly including first and second doors, at least one of the first and second doors including:

a door frame assembly formed from ultra high strength steel, a plurality of panels connected to the door frame assembly and formed from ultra high strength steel, each of the plurality of panels having a first shape configuration, first and second connection pipe assemblies including first and second lock rods formed from ultra high strength steel, and a locking assembly connected to the door frame assembly and formed from a high strength steel, wherein a force incurred by an interior of one or more of the plurality of panels causes the one or more of the plurality of panels to be changed to a second shape configuration different from the first shape configuration, and wherein the force is transferred to and absorbed by one or more of the door frame assembly and the first and second connection pipe assemblies such that the one or more of the plurality of panels is returned from the second shape configuration to the first shape configuration, wherein the ultra high strength steel has a yield strength of 140 ksi (965 MPa) or higher and a tensile strength of 170 ksi (1170 MPa) or higher.

* * * * *